US008327678B1

(12) United States Patent
Chen

(10) Patent No.: US 8,327,678 B1
(45) Date of Patent: Dec. 11, 2012

(54) ROLL-FORMING MACHINE WITH A FEED GAP ADJUSTMENT STRUCTURE

(76) Inventor: Chun-Liang Chen, Taipei Hsien (TW)

( * ) Notice: Subject to any disclaimer, the term of this patent is extended or adjusted under 35 U.S.C. 154(b) by 351 days.

(21) Appl. No.: 12/694,814

(22) Filed: Jan. 27, 2010

(51) Int. Cl.
*B21D 5/08* (2006.01)

(52) U.S. Cl. ..... 72/181

(58) Field of Classification Search ..... 72/176, 72/179, 180, 181
See application file for complete search history.

(56) References Cited

U.S. PATENT DOCUMENTS 5,052,454 A * 10/1991 Meinhardt ..... 144/144.51
5,970,764 A * 10/1999 Surina ..... 72/7.6
6,604,397 B2 * 8/2003 Patty et al. ..... 72/178
6,644,086 B1 * 11/2003 Bodnar ..... 72/181
7,243,519 B1 * 7/2007 Chuang ..... 72/181
7,325,473 B2 * 2/2008 Belfiglio ..... 83/824
2010/0180745 A1 * 7/2010 Hall ..... 83/745

* cited by examiner

*Primary Examiner* — Dana Ross
*Assistant Examiner* — Homer Boyer
(74) *Attorney, Agent, or Firm* — Jackson IPG PLLC

(57) ABSTRACT

A roll-forming machine in which the left and right racks of each shape-forming roll set each have two guide blocks affixed thereto at two opposite sides in an opening thereof, each guide block having an oblique sliding slot, and left and right upper bearing blocks of each shape-forming roll set each have two sliding blocks respectively affixed to two opposite lateral sides thereof and respectively coupled to the oblique sliding slots of the guide blocks and movable upwards/downwards along the respective oblique sliding slots for adjustment of the feed gap between the upper shape-forming wheel set and lower shape-forming wheel set of the respective shape-forming roll set in X-axis and Y-axis directions at a time.

3 Claims, 8 Drawing Sheets

ROLL-FORMING MACHINE WITH A FEED GAP ADJUSTMENT STRUCTURE

BACKGROUND OF THE INVENTION

1. Field of the Invention

The present invention relates to a roll-forming machine and more particularly, to a roll-forming machine with a feed gap adjustment structure, which allows adjustment of feed gap in X-axis and Y-axis directions simultaneously.

2. Description of the Related Art

Many roll-forming machines are known and used to transform a planar sheet of metal into a component. In a regular roll-forming machine, the horizontal and vertical feed gaps between the upper shape-forming wheel set and the lower shape-forming wheel set are to be adjusted by a horizontal (X-axis) feed gap adjustment mechanism and a vertical (Y-axis) feed gap adjustment mechanism respectively to fit different sheet materials of different thicknesses. This feed gap adjustment operation is complicated. Further, the horizontal (X-axis) feed gap adjustment mechanism and the vertical (Y-axis) feed gap adjustment mechanism require much installation space. Further, the installation of the horizontal (X-axis) feed gap adjustment mechanism and the vertical (Y-axis) feed gap adjustment mechanism greatly increases the machine cost. Further, adjustment of the feed gap requires much labor and time.

Therefore, it is desirable to provide a feed gap adjustment structure for roll-forming machine that eliminates the aforesaid drawbacks.

SUMMARY OF THE INVENTION

The present invention has been accomplished under the circumstances in view. It is therefore the main object of the present invention to provide a roll-forming machine, which eliminates the aforesaid drawbacks. It is therefore an object of the present invention to provide a roll-forming machine with a feed gap adjustment structure, which allows adjustment of the sheet material feed gap in X-axis and Y-axis directions conveniently at a time. It is another object of the present invention to provide a roll-forming machine with a feed gap adjustment structure, which saves much labor and time in feed gap adjustment and facilitates maintenance and repair works.

To achieve these and other objects of the present invention, a roll-forming machine includes two guide blocks fixedly mounted on two opposite sides in an opening of each of left and right racks thereof, each guide block having an oblique sliding slot, and two sliding blocks respectively affixed to two opposite lateral sides of each of the left and right upper bearing blocks of each shape-forming roll set thereof and respectively coupled to the oblique sliding slots of the guide blocks at the let and right racks and movable upwards/downwards along the respective oblique sliding slots for adjustment of the feed gap between the upper shape-forming wheel set and lower shape-forming wheel set of the respective shape-forming roll set in X-axis and Y-axis directions at a time.

DETAILED DESCRIPTION OF THE INVENTION

Figure 1:
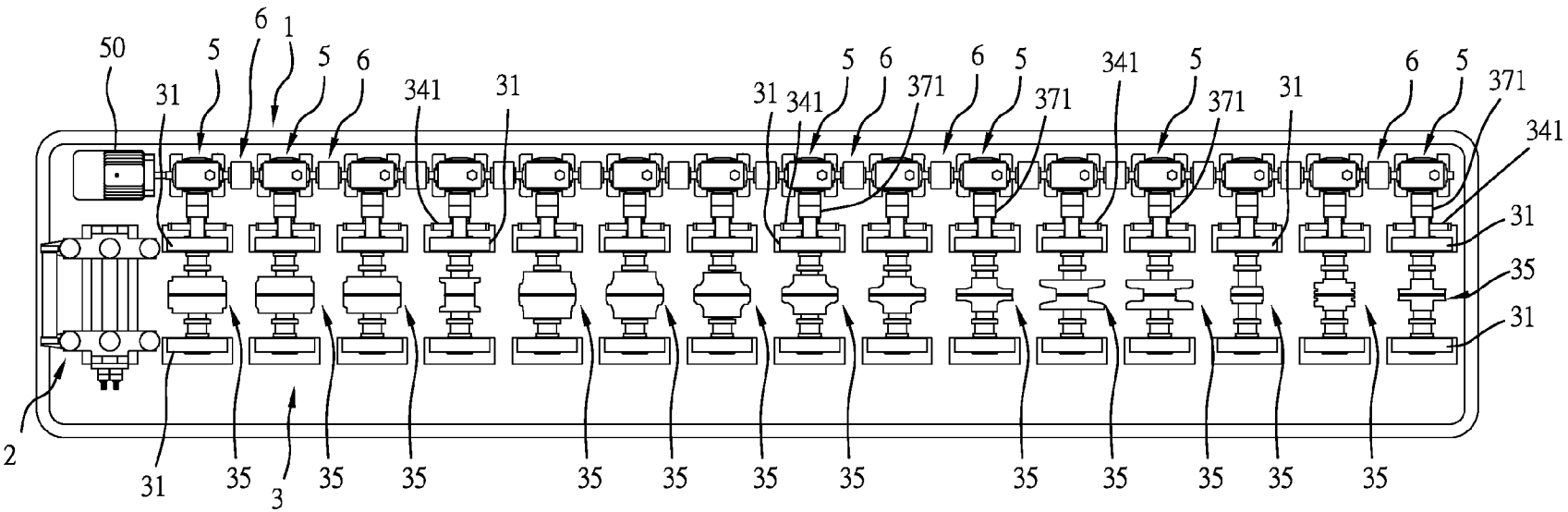
FIG. 1 is a top plain view of a roll-forming machine according to the present invention.
Figure 2:
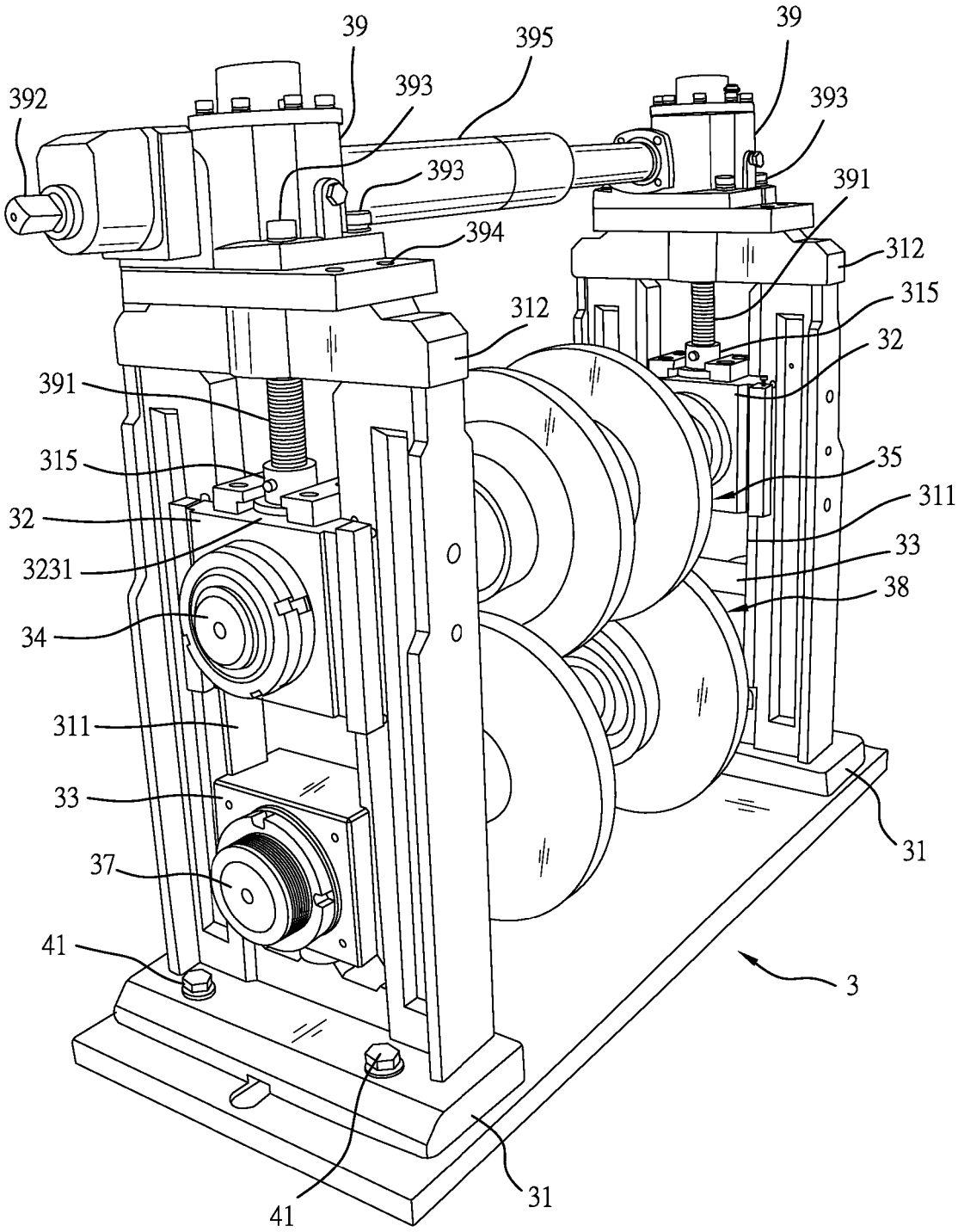
FIG. 2 is an elevational view, in an enlarged scale, of one shape-forming roll set of the roll-forming machine according to the present invention.

Referring to FIG. 1, a roll-forming machine with a feed gap adjustment structure in accordance with the present invention is shown for the formation of a component from a sheet of material. The roll-forming machine comprises a machine base 1, a guide block unit 2 provided at the front top side of the machine base 1 for guiding a sheet material into the machine base 1 for processing, shape-forming roll sets 3 bilaterally arranged on the top side of the machine base 1, a plurality of speed reducers 5, a plurality of couplings 6 connecting the speed reducers 5, and a motor 50 for rotating the speed reducers 5.

The number of the shape-forming roll sets 3 is 15 numbered from $1^{st}$ through $15^{th}$. As shown in FIGS. 2-5, each shape-forming roll set 3 comprises:

left and right racks 31 respectively affixed to the machine base 1 with fastening members 41 (see FIG. 2), each rack 31 having an opening 311 and a top locating block 312;

left and right upper bearing blocks 32 respectively symmetrically mounted in the openings 311 of the left and right racks 31 near the top side;

an upper shaft 34 pivotally connected between the left and right upper bearing blocks 32;

an upper shape-forming wheel set 35 fixedly mounted on the upper shaft 34;

an upper gearwheel 341 fixedly mounted on one end of the upper shaft 34 (see FIG. 1);

left and right lower bearing blocks 33 respectively symmetrically mounted in the openings 311 of the left and right racks 31 near the bottom side;

a lower shaft 37 pivotally connected between the left and right lower bearing blocks 33;

a lower shape-forming wheel set 38 fixedly mounted on the lower shaft 37;

a lower gearwheel (not shown) fixedly mounted on one end of the lower shaft 37 and meshed with the upper gearwheel 341;

a coupling 371 (see FIG. 1) coupled between the lower shaft 37 and one speed reducer 5 for enabling the lower shaft 37 to be rotated by the speed reducer 5 to cause rotation of the upper gearwheel 341 and the upper shaft 34;

left and right lifters 39 respectively fixedly mounted on the top locating blocks 312 of the left and right racks 31, each lifter 39 comprising a screw rod 391 inserted through the associating top locating block 31 and rotatable to move the associating upper bearing block 32 upwards or downwards, an axle 392 rotatable to rotate the screw rod 391; and a link 395 coupled between the axles 392 of the left and right lifters 39 such that when one axle 392 is rotated clockwise or counter-clockwise, the screw rods 391 of the left and right lifters 39 are rotated to move the left and right upper bearing blocks 32 upwards or downwards.

The main features of the present invention are outlined hereinafter.

Figure 3:
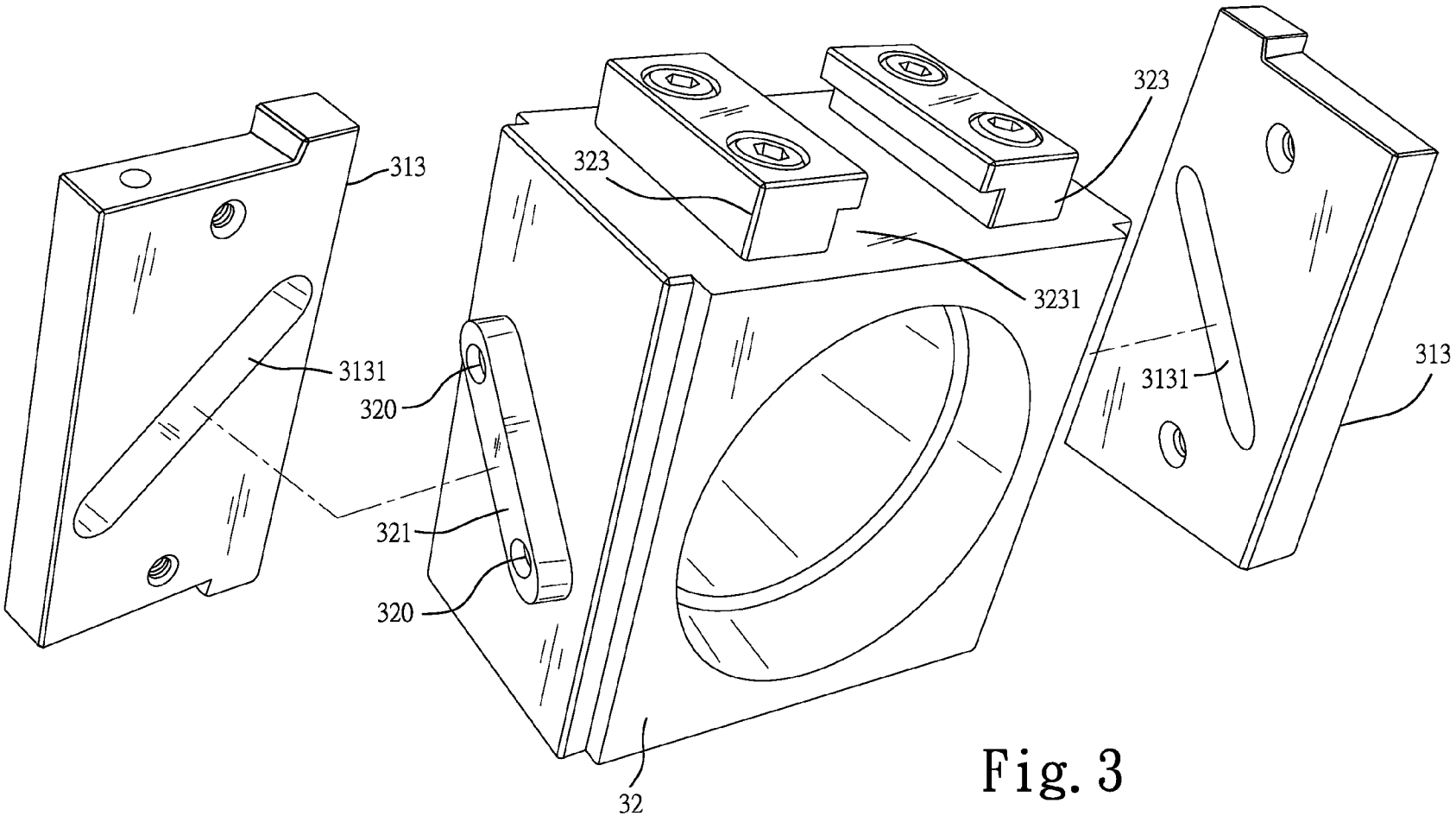
FIG. 3 is an exploded view in an enlarged scale of a part of the roll-forming machine according to the present invention, showing the relationship between one upper bearing block and the associating guide blocks.
Figure 5:
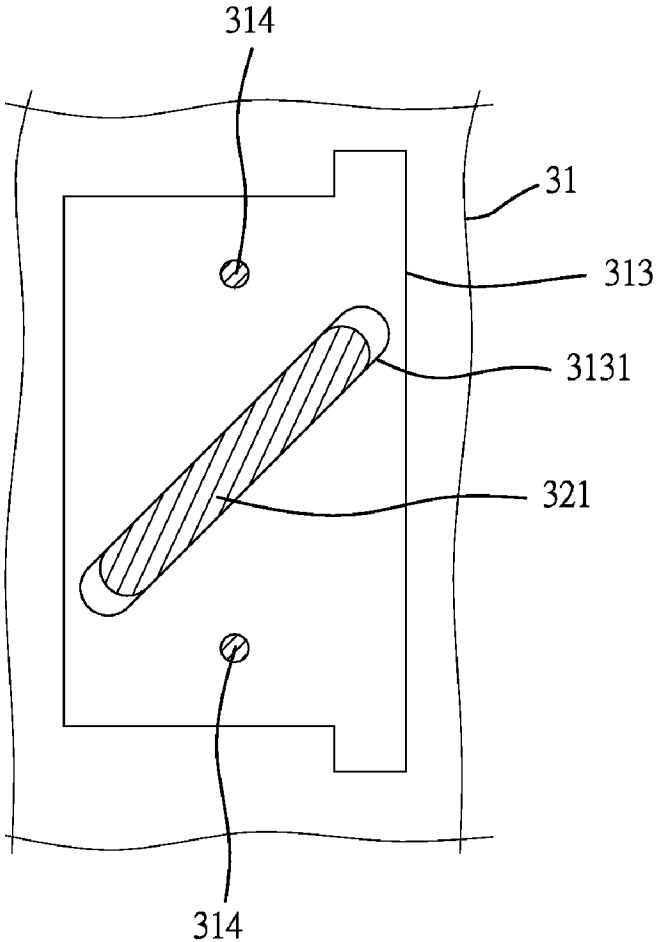
FIG. 5 corresponds to FIG. 4, showing the sliding block moved relative to the oblique sliding slot of the associating guide block.
Figure 4:
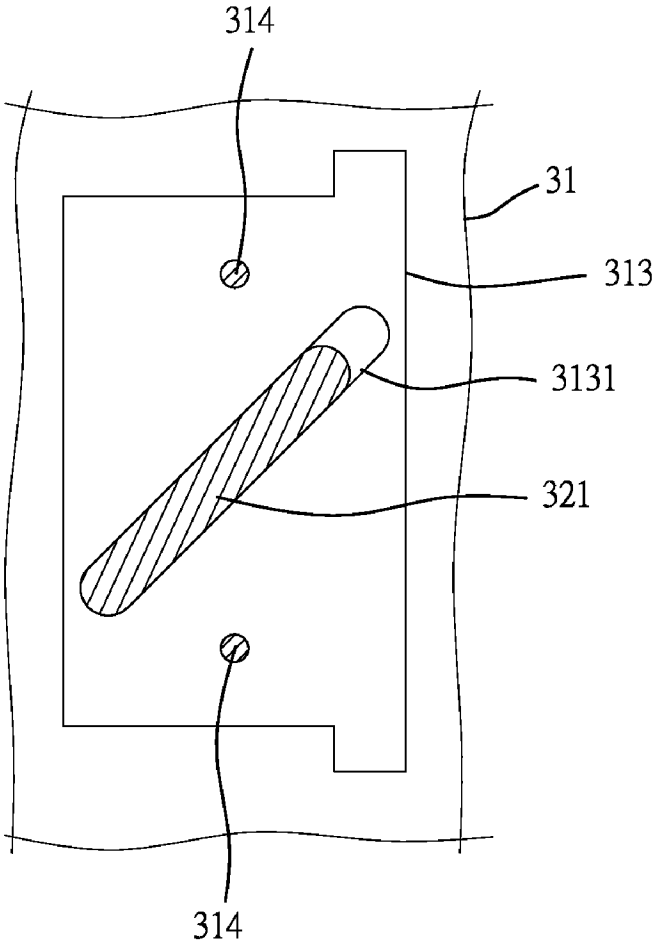
FIG. 4 is a schematic drawing of the present invention, showing one sliding block of one upper bearing block coupled to the oblique sliding slot of the associating guide block.

Each of the left and right racks 31 has two guide blocks 313 affixed thereto by fastening members 314 (see FIGS. 4 and 5) and arranged at two opposite sides in the opening 311. Each guide block 313 has an oblique sliding slot 3131 (see FIGS. 2 and 3);

Each of the left and right upper bearing blocks 32 has two sliding blocks 321 respectively affixed to two opposite lateral sides thereof by fastening members 320 (see FIG. 3). The sliding blocks 321 of the left and right upper bearing blocks 32 are respectively coupled to the oblique sliding slots 3131 of the guide blocks 313 at the left and right racks 31 and movable upwards or downwards along the respective oblique sliding slots 3131 (see FIGS. 4 and 5).

Based on the aforesaid structural features, when one end of the axle 392 of one lifter 39 (see FIG. 2) is rotated clockwise or counter-clockwise by a hand tool or motor drive, the screw rods 391 of the lifters 39 are synchronously rotated to move the upper bearing blocks 32 upwards or downwards. Because the sliding blocks 321 of the left and right upper bearing blocks 32 are respectively coupled to the oblique sliding slots 3131 of the guide blocks 313 at the left and right racks 31 (see FIGS. 4 and 5), the upper bearing blocks 32 are moved obliquely upwards or downwards during rotation of the screw rods 391 of the lifters 39, achieving adjustment of feed gap in X-axis and Y-axis directions. Therefore, when the upper shape-forming wheel set 35 is moved obliquely upwards or downwards with the upper bearing blocks 32, the feed gap between the upper shape-forming wheel set 35 and the lower shape-forming wheel set 38 is adjusted in X-axis and Y-axis directions subject to the thickness of the sheet material to be processed.

Further, the oblique sliding slots 3131 of the guide blocks 313 at the left and right racks 31 have a length longer than the length of the sliding blocks 321 of the left and right upper bearing blocks 32 to facilitate upward or downward sliding of the respective sliding blocks 321 in the respective oblique sliding slots 3131.

Referring to FIG. 3, each upper bearing block 32 has a coupling groove 3231 defined at the top side for the coupling of a connection block 315 that is coupled to the bottom end of the screw rod 391 of the associating lifter 39 so that when the screw rod 391 is moved upwards or downwards, the associating connection block 315 and the associating upper bearing block 32 are simultaneously moved.

Further, two angled blocks 323 are fixedly mounted on the top side of the left (right) upper bearing block 32 by fastening members 322, thereby defining the respective coupling groove 3231. The connection block 315 is coupled to the coupling groove 3231 between the two angled blocks 323. The two connection blocks 315 are conveniently detachable, facilitating installation.

Figure 6:
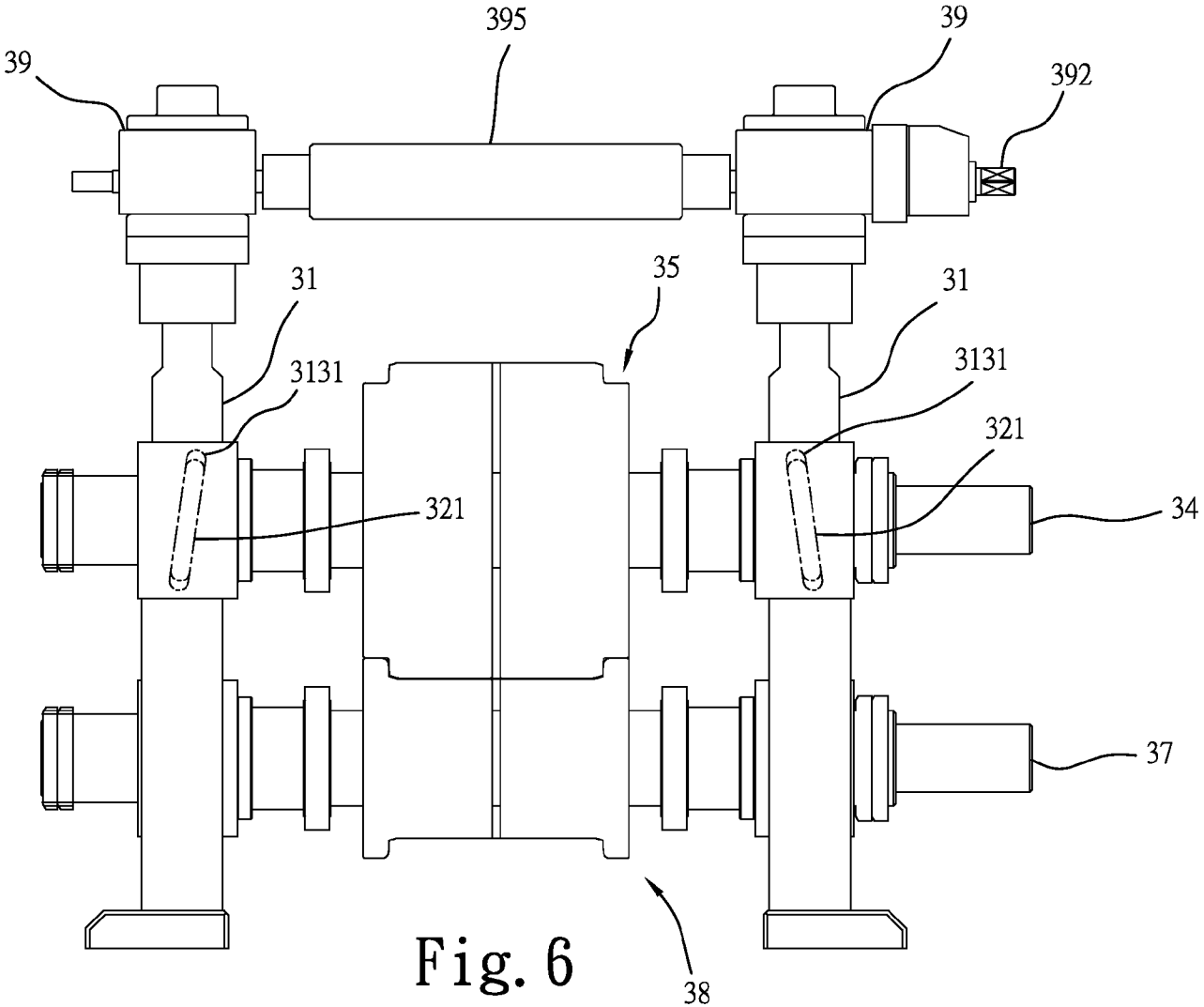
FIG. 6 is a schematic front plain view of the first shape-forming roll set of the roll-forming machine according to the present invention.
Figure 7:
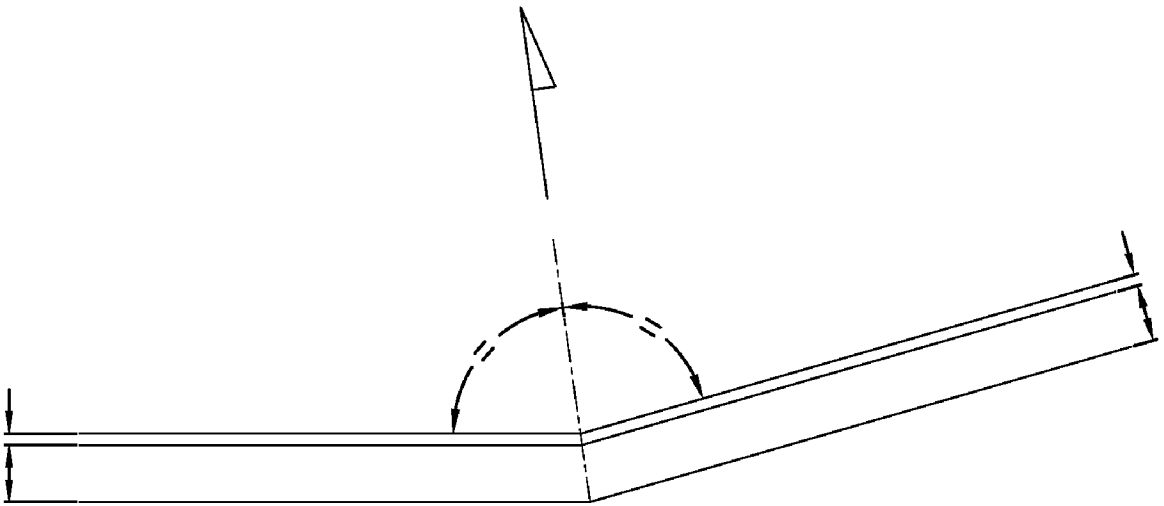
FIG. 7 is a schematic drawing showing an angle change of the sliding block of the left (right) upper bearing block of the $1^{st}$ shape-forming roll set after an upward adjustment.
Figure 8:
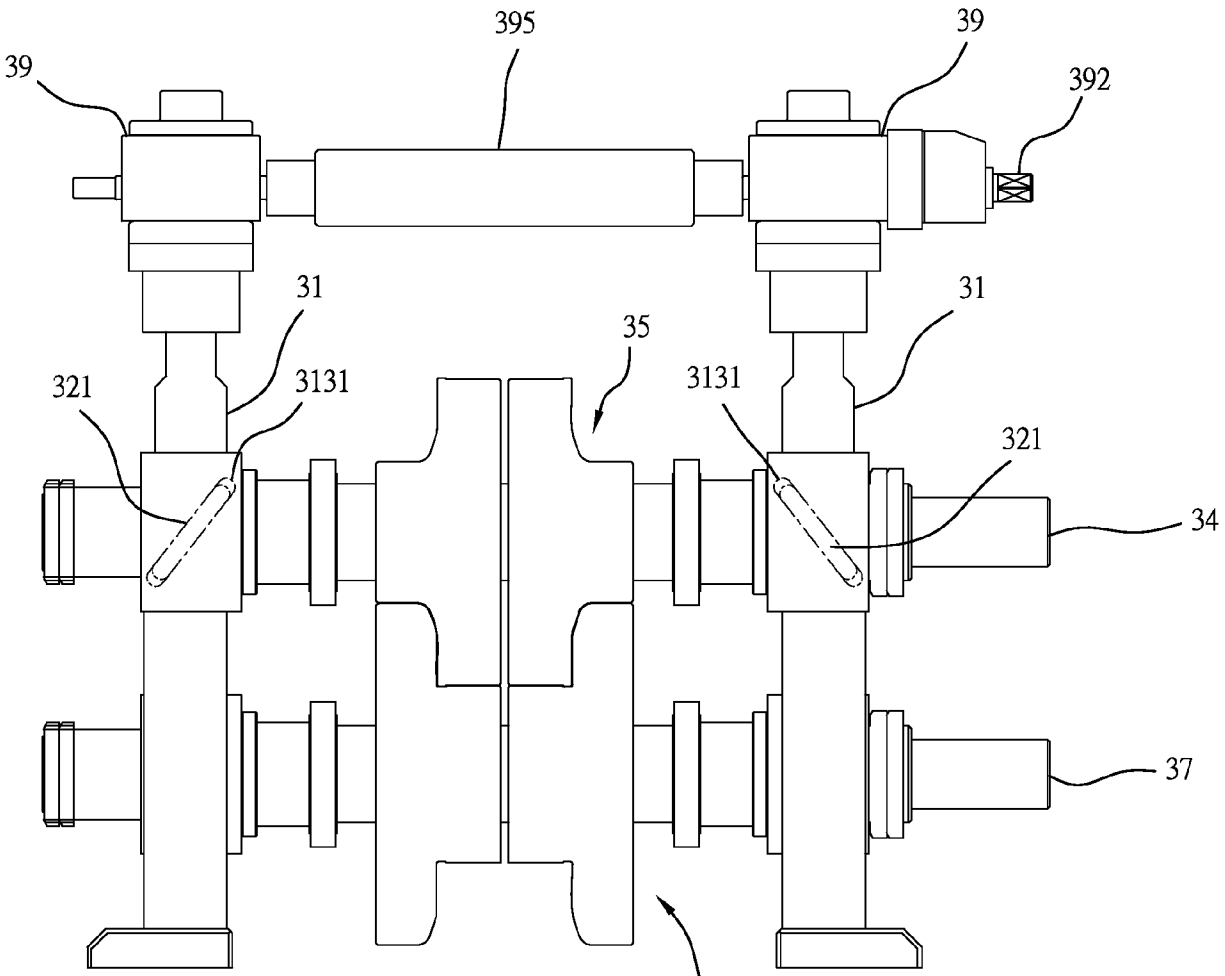
FIG. 8 is a schematic front plain view of the $10^{th}$ shape-forming roll set of the roll-forming machine according to the present invention.
Figure 9:
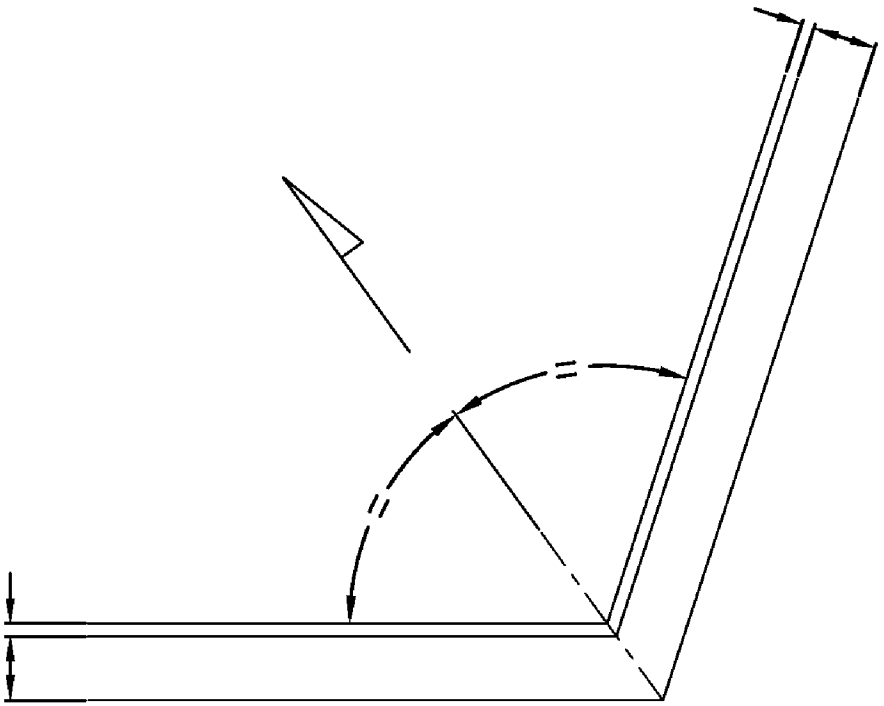
FIG. 9 is a schematic drawing showing an angle change of the sliding block of the left (right) upper bearing block of the $10^{th}$ shape-forming roll set after an upward adjustment.

Further, the sloping angle of the sliding blocks 321 of the left and right upper bearing blocks 32 and the oblique sliding slots 3131 of the guide blocks 313 of each shape-forming roll set 3 is determined during fabrication subject to actual requirements. For example, the dotted lines in the schematic front plain view of the first shape-forming roll set of the roll-forming machine in FIG. 6 show the sloping angle of the sliding slots 3131 and the sliding blocks 321. FIG. 7 shows an angle change of the sliding block of the left (right) upper bearing block of the $1^{st}$ shape-forming roll set after an upward adjustment. As illustrated, the contained angles the two sides are the same. FIG. 8 is a schematic front plain view of the $10^{th}$ shape-forming roll set of the roll-forming machine according to the present invention in which the sloping angle of the sliding slots 3131 and the sliding blocks 321 indicated by dotted lines is different from that of the $1^{st}$ shape-forming roll set shown in FIG. 6. FIG. 9 is a schematic drawing showing an angle change of the sliding block of the left (right) upper bearing block of the $10^{th}$ shape-forming roll set after an upward adjustment. As illustrated, the contained angles the two sides are the same.

In conclusion, the invention provides a roll-forming machine with a feed gap adjustment structure, which has the following advantages and features:

1. By means of moving the two oblique sliding blocks 321 of each upper bearing block 32 of each shape-forming roll set 3 along the associating oblique sliding slots 3131 upwards or downwards, the feed gap between the upper shape-forming wheel set 35 and the lower shape-forming wheel set 38 is adjusted in X-axis and Y-axis directions to fit different sheet materials having different thicknesses.

2. By means of using a hand tool or motor drive to rotate the axle 392 of one lifter 39 clockwise or counter-clockwise, the feed gap between the upper shape-forming wheel set 35 and the lower shape-forming wheel set 38 is relatively adjusted in X-axis and Y-axis directions. Therefore, the adjustment of the feed gap is quite simple 3. The feed gap adjustment structure of the roll-forming machine is quite simple and easy to install. By means of using this feed gap adjustment structure to replace a conventional horizontal feed gap adjustment structure and a conventional vertical feed gap adjustment structure, the invention saves much installation labor and time and greatly reduces the cost of the roll-forming machine.

4. By means of removing the fastening members 393 and 394 from the lifters 39 and the top locating blocks 312 and the left and right racks 31 (see FIG. 2) and the fastening members 314 from the guide blocks 313, the upper shape-forming wheel set 35 and the lower shape-forming wheel set 38 can then be detached from the upper bearing blocks 32 and the lower bearing blocks 33 for maintenance or repair.

A prototype of roll-forming machine has been constructed with the features of FIGS. 1~9. The roll-forming machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A roll-forming machine for the formation of components from sheet materials, comprising:

a machine base, a guide block unit provided at a front top side of said machine base for guiding a sheet material into said machine base for processing, a plurality of speed reducers, a plurality of couplings connecting said speed reducers, a motor for rotating said speed reducers, and shape-forming roll sets bilaterally arranged on said machine base, each said shape-forming roll set comprising:

left and right racks respectively affixed to said machine base with fastening members, each said rack having an opening and a top locating block;

left and right upper bearing blocks respectively symmetrically mounted in the openings of said left and right racks near a top side;

an upper shaft pivotally connected between said left and right upper bearing blocks;

an upper shape-forming wheel set fixedly mounted on said upper shaft;

an upper gearwheel fixedly mounted on one end of said upper shaft;

left and right lower bearing blocks respectively symmetrically mounted in the openings of said left and right racks near a bottom side;

a lower shaft pivotally connected between said left and right lower bearing blocks;

a lower shape-forming wheel set fixedly mounted on said lower shaft;

a lower gearwheel fixedly mounted on one end of said lower shaft and meshed with said upper gearwheel;

a coupling coupled between said lower shaft and one said speed reducer for enabling said lower shaft to be rotated by the speed reducer to cause rotation of said upper gearwheel and said upper shaft;

left and right lifters respectively fixedly mounted on said top locating blocks of said left and right racks, each said lifter comprising a screw rod inserted through the associated top locating block and rotatable to move the associated upper bearing block upwards/downwards and an axle rotatable to rotate the screw rod;

a coupling groove defined at a top side each said upper bearing block configured to the couple to a connection block coupled to a bottom end of the screw rod of the associated lifter; and a link coupled between the axles of said left and right lifters such that when one axle is rotated clockwise/counterclockwise, the screw rods of said left and right lifters are rotated to move said left and right upper bearing blocks upwards/downwards; wherein:

said left and right racks each have two guide blocks affixed thereto by fastening members and arranged at two opposite sides in the opening of the respective rack, each said guide block having an oblique sliding slot;

said left and right upper bearing blocks each have two sliding blocks respectively affixed to two opposite lateral sides thereof by fastening members, the sliding blocks of said left and right upper bearing blocks being respectively coupled to the oblique sliding slots of said guide blocks at said left and right racks and movable upwards/downwards along the respective oblique sliding slots such that, as respective pairs of left and right upper bearing blocks are urged to move upwards/downwards, they are simultaneously urged to move inwards/outwards and wherein obliquity of the respective oblique sliding slots and sliding slots varies among the plurality of shape-forming rolls sets such that a ratio of upwards/downwards movement to inwards/outwards movement varies among the plurality of shape-forming rolls sets.

2. The roll-forming machine as claimed in claim 1, wherein said oblique sliding slots of said guide blocks at said left and right racks have a length longer than the length of the sliding blocks of said left and right upper bearing blocks.

3. The roll-forming machine as claimed in claim 1, wherein each said upper bearing block has two angled blocks mounted on a top side thereof, said angled blocks defining the coupling groove.

* * * * *